US009440457B2

(12) United States Patent
Gazit

(10) Patent No.: US 9,440,457 B2
(45) Date of Patent: Sep. 13, 2016

(54) MEDIA TREATMENT APPARATUS

(71) Applicant: Alon Gazit, Kfar Hanagid (IL)

(72) Inventor: Alon Gazit, Kfar Hanagid (IL)

(73) Assignee: Hewlett-Packard Indigo B.V., Amstelveen (NL)

( * ) Notice: Subject to any disclaimer, the term of this patent is extended or adjusted under 35 U.S.C. 154(b) by 0 days.

(21) Appl. No.: 14/435,706

(22) PCT Filed: Oct. 24, 2012

(86) PCT No.: PCT/EP2012/071086
§ 371 (c)(1),
(2) Date: Apr. 14, 2015

(87) PCT Pub. No.: WO2014/063731
PCT Pub. Date: May 1, 2014

(65) Prior Publication Data
US 2015/0283829 A1 Oct. 8, 2015

(51) Int. Cl.
*B41J 2/15* (2006.01)
*B41J 11/00* (2006.01)
*B41J 23/08* (2006.01)

(52) U.S. Cl.
CPC ..... *B41J 11/0015* (2013.01); *B41J 23/08* (2013.01)

(58) Field of Classification Search
CPC ..... B41J 2/15; B41J 11/0015; B41J 23/08; B41J 23/005
USPC ..... 347/9
See application file for complete search history.

(56) References Cited

U.S. PATENT DOCUMENTS 4,196,437 A * 4/1980 Hertz ..... G01D 15/18 118/325
4,621,268 A * 11/1986 Keeling ..... B05B 5/08 239/3
6,477,948 B1 * 11/2002 Nissing ..... B41M 1/36 101/211
7,717,551 B2 * 5/2010 Kadomatsu ..... B41J 2/2114 347/100
2006/0153989 A1 * 7/2006 Horsnell ..... B41J 2/2114 427/401
2009/0061177 A1 3/2009 Kriha et al.
2009/0295894 A1 * 12/2009 Hori ..... B41J 2/155 347/102
2009/0311426 A1 12/2009 Nakazawa et al.
2010/0328388 A1 12/2010 Takekoshi et al.
2011/0132213 A1 6/2011 DeJoseph et al.
2011/0146510 A1 6/2011 Bolognini
2011/0310185 A1 12/2011 Komaba et al.
2015/0043998 A1 * 2/2015 Janssen ..... B41F 23/02 412/33

FOREIGN PATENT DOCUMENTS

DE 102005021186 A1 11/2005
DE 102005021186 A1 * 11/2005 ..... B41F 23/08
DE 102006051275 A1 5/2008

OTHER PUBLICATIONS

"Hydrokett TM Prime Ink System", http://www.flintgrp.com/en/documents/Packaging-and-Narrowweb/Narrowweb/HydrokettPrime_ver1US.pdf.

* cited by examiner

*Primary Examiner* — Julian Huffman
*Assistant Examiner* — Michael Konczal
(74) *Attorney, Agent, or Firm* — HP Inc Patent Department

(57) ABSTRACT

Media treatment apparatus to apply liquid treatment to media, the media treatment apparatus including a roller to receive liquid treatment and to transfer the liquid treatment, and a drop ejector to apply liquid treatment to the roller to transfer liquid treatment to an object.

19 Claims, 5 Drawing Sheets

MEDIA TREATMENT APPARATUS

BACKGROUND

Media treatment apparatus may be used to apply a layer of liquid treatment on media (such as paper) prior to or after the deposition of ink on the media. For example, media treatment apparatus may apply a pre-printing treatment (such as primer) to the media to improve the fixing of the ink to the media (and transferability of the ink from the intermediate transfer (ITM) drum) and thereby improve the quality of printed text and/or images on the substrate. By way of another example, media treatment apparatus may be used to apply a layer of post-printing treatment (such as varnish) on media after the deposition of ink on the media.

BRIEF DESCRIPTION

Reference will now be made by way of example only to the accompanying drawings in which.

DETAILED DESCRIPTION

Figure 1:
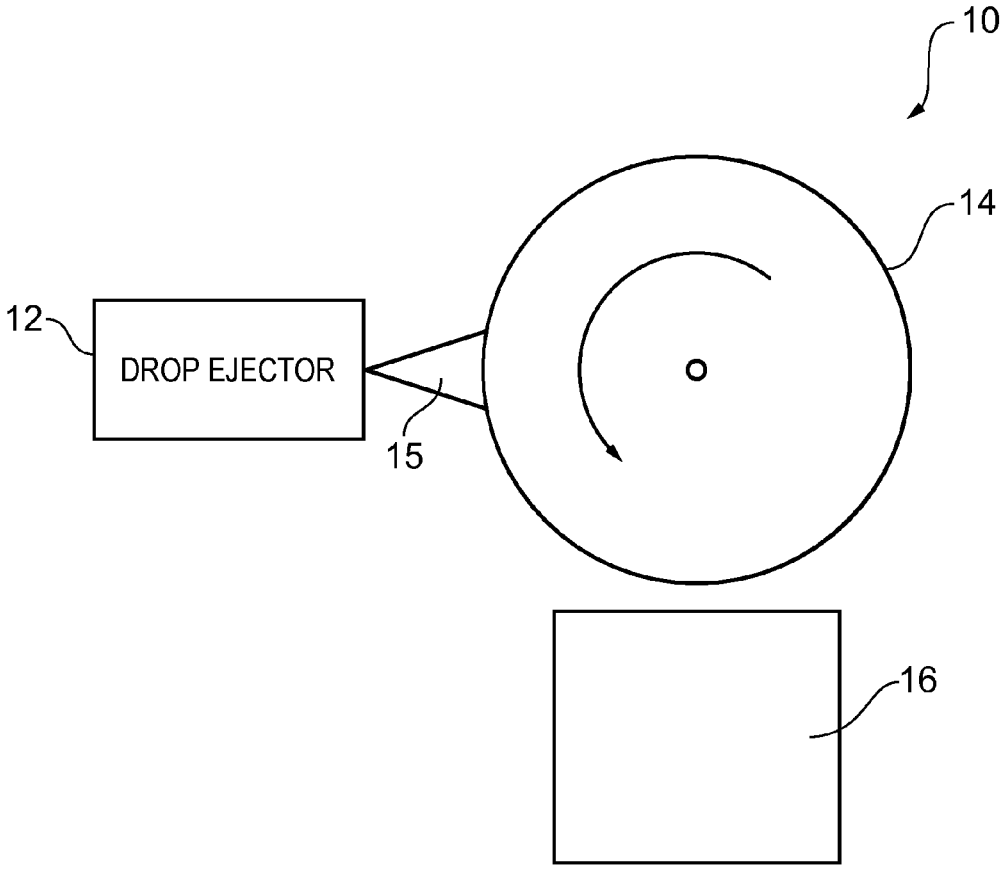
FIG. 1 illustrates a schematic diagram of a media treatment apparatus according to an example.

FIG. 1 illustrates a schematic diagram of a media treatment apparatus 10 including a drop ejector 12 and a roller 14. The media treatment apparatus 10 is arranged to apply liquid treatment 15 (such as primer or varnish) to media (such as paper, fabric, or plastic). The media treatment apparatus 10 may be an integral non-removable part of a printer apparatus that includes a printer. In another example, the media treatment apparatus 10 may be a removable part of a printer apparatus or may be standalone device that is not part of a printer apparatus. In some examples, the media treatment apparatus 10 is a module. As used here, the term 'module' refers to a unit or apparatus that excludes certain parts/components that would be added by an end manufacturer or a user. For example, a doctor blade may be added to the media treatment apparatus 10 to remove excess liquid treatment 15 from the roller 14.

The drop ejector 12 may be any suitable device for applying liquid treatment 15 to the roller 14 and may comprise, for example, one or more inkjet printheads mounted on a moveable carriage, or may comprise one or more spray nozzles that are adjustable to provide a variable width of spray of liquid treatment 15. The drop ejector 12 may be moved along the length of the roller 14 on a carriage bar, or a plurality of drop ejectors could be provided in a 'page-wide array' arrangement. The drop ejector 12 may include individually controllable segments that provide liquid treatment 15 or may include a plurality of individually controllable shutters that restrict or wholly prevent the spray of liquid treatment 15 from portions of the drop ejector 12.

The roller 14 may be any suitable roller for receiving liquid treatment 15 from the drop ejector 12 and for transferring the liquid treatment 15 to an object 16. For example, the roller 14 may be an anilox roller that has a core (comprising a metal such as steel or aluminium) which is coated by a material (such as a ceramic) having a surface that contains a plurality of cells for receiving the liquid treatment 15. In other examples, the roller 14 may be a polyurethane roller, a metal roller or a rubber roller. The object 16 may be another roller (such as a roller having an outer surface comprising rubber) or may be a sheet or web of media.

The media treatment apparatus 10 provides an advantage in that by applying liquid treatment 15 to the roller 14 instead of directly to media, a relatively uniform layer of liquid treatment 15 may be applied to the media. Additionally, where the amount of liquid treatment 15 transferred to the media is reduced (for example, by increasing the speed of rotation of the roller 14 or by reducing the rate of spray from the drop ejector 12), this may advantageously reduce the drying time for the applied liquid treatment and may improve the quality of the printed content on the media.

Figure 2:
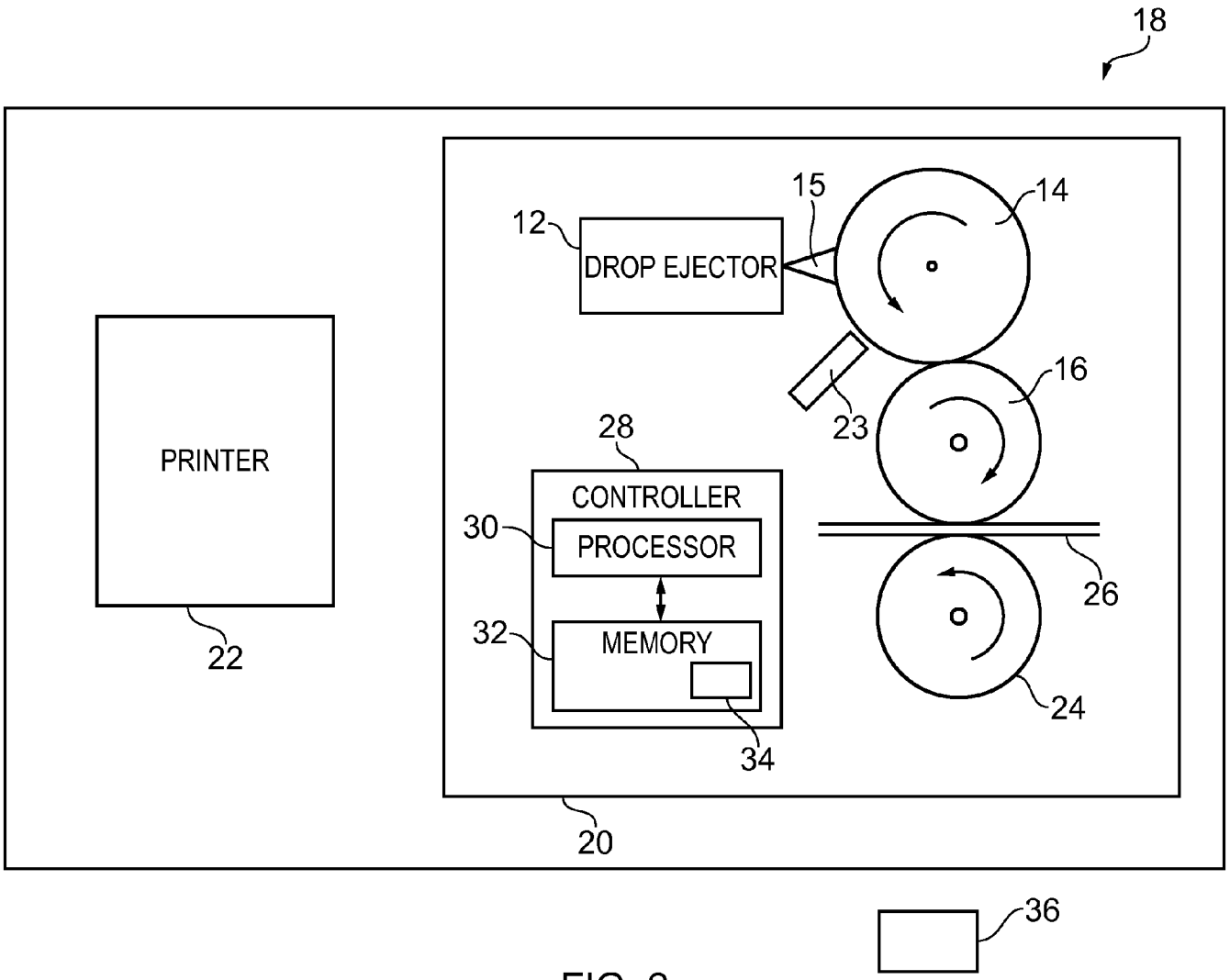
FIG. 2 illustrates a schematic diagram of a printing apparatus including a printer and a media treatment apparatus according to an example.

FIG. 2 illustrates a schematic diagram of printer apparatus 18 including a media treatment apparatus 20 and a printer 22. The media treatment apparatus 20 is similar to the media treatment apparatus 10 illustrated in FIG. 1 and where the features are similar, the same reference numerals are used. The printer 22 may be any suitable printing device for applying ink to media to form text and/or images on the media. For example, the printer 22 may be an inkjet printer, a laser printer, an analogue offset printer, or a solid ink printer.

In some examples, media may first be provided to the media treatment apparatus 20 and then subsequently to the printer 22. In these examples, the liquid treatment is a pre-printing treatment such as primer. In other examples, media may first be provided to the printer 22 and then subsequently to the media treatment apparatus 20. In these examples, the liquid treatment is a post-printing treatment such as varnish.

The media treatment apparatus 20 includes a drop ejector 12, a first roller 14 (e.g. an anilox roller), a second roller 16 (e.g. a rubber roller), a doctor blade 23, an impression drum 24 and a controller 28. The drop ejector 12, the first roller 14, the second roller 16 and the doctor blade 23 form an anilox device for applying liquid treatment to media. The controller 28 is arranged to control the operation of the anilox device as described in more detail in the following paragraphs.

The implementation of the controller 28 can be in hardware alone (for example, a circuit, a processor and so on), have certain aspects in software including firmware alone or can be a combination of hardware and software (including firmware).

The controller 28 may be implemented using instructions that enable hardware functionality, for example, by using executable computer program instructions in a general-purpose or special-purpose processor 30 that may be stored on a computer readable storage medium 32 (disk, memory etc) to be executed by such a processor 30.

The processor 30 is configured to read from and write to the memory 32. The processor 30 may also comprise an output interface via which data and/or commands are output by the processor 30 and an input interface via which data and/or commands are input to the processor 30.

The memory 32 stores a computer program 34 comprising computer program instructions that control the operation of the media treatment apparatus 20 when loaded into the processor 30. The computer program instructions 34 provide the logic and routines that enables the media treatment apparatus 20 to perform the methods illustrated in FIG. 3.

The processor 30 by reading the memory 32 is able to load and execute the computer program 34.

The computer program 34 may arrive at the media treatment apparatus 20 via any suitable delivery mechanism 36. The delivery mechanism 36 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 34. The delivery mechanism 36 may be a signal configured to reliably transfer the computer program 34. The media treatment apparatus 20 may propagate or transmit the computer program 34 as a computer data signal.

Although the memory 32 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analogue and/or digital circuitry) and
(b) to combinations of circuits and software (and/or firmware), such as (as applicable): (i) to a combination of processor(s) or (ii) to portions of processor(s)/software (including digital signal processor(s)), software, and memory(ies) that work together to cause an apparatus to perform various functions) and
(c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware.

The controller 28 is arranged to control the operation of the drop ejector 12, the first roller 14, the second roller 16 and the impression drum 24. Control lines from the controller 28 to these components are not illustrated in FIG. 2 to maintain the clarity of FIG. 2.

In more detail, the controller 28 is arranged to control the first roller 14 to rotate in an anti-clockwise direction, control the second roller 16 to rotate in a clockwise direction and control the impression drum 24 to rotate in an anti-clockwise direction. The second roller 16 and the impression drum 24 form a nip through which media 26 travels through. Liquid treatment 15 is transferred from the drop ejector 12, to the first roller 14, to the second roller 16 and then to the media 26 as the media 26 travels through the nip formed between the second roller 16 and the impression drum 24.

The doctor blade 23 is positioned adjacent the first roller 14 between the drop ejector 12 and the second roller 16 and is arranged to remove excess liquid treatment 15 from the first roller 14. In some examples, the controller 28 may be arranged to control the position of the doctor blade 23 and move the doctor blade 23 towards and away from the first roller 14. This may advantageously help to control the amount of excess liquid treatment 15 removed by the doctor blade 23. The amount of liquid treatment 15 transferred to the media 26 may also be controlled by controlling the relative velocity of the first and second rollers 14 and 16, controlling the distance of the drop ejector 12 to the first roller 14, the flow rate to the drop ejector 12 and pressure in the jet of the drop ejector 12.

The operation of the media treatment apparatus 20 is described in the following paragraphs with reference to FIGS. 2 and 3.

At block 38, the controller 28 determines a width and/or a length and/or a pattern for applying liquid treatment.

In some examples, the media treatment apparatus 20 and/or the printer apparatus 18 includes a sensor for sensing the dimensions of media 26 and provides the sensed dimensions to the controller 28. The controller 28 analyses the sensed dimensions in the signal from the sensor and determines a width and/or a length for applying liquid treatment. The determined width and length for applying liquid treatment may be equal to, or less than, the sensed width and length of the media. The determined width may thus be less than the width of the roller 14.

In other examples, the controller 28 determines the length and/or width for applying liquid treatment by analysing a user input signal that includes the dimensions of the media as specified by the user. For example, the user may input to the printer apparatus 18 that the media includes sheets of A4 paper and the controller 28 determines the length and/or width for applying liquid treatment to be equal to, or less than, the length and width of A4.

The controller 28 may determine the pattern for applying liquid treatment by analysing the content of information to be printed (or that has been printed) such that areas which include content receive liquid treatment, and areas which do not include content, do not receive liquid treatment.

At block 40, the controller 28 controls the drop ejector 12 to selectively apply liquid treatment to the roller 14. The controller 28 may use the width and/or length and/or pattern determined in block 38 to control the drop ejector 12 to apply liquid treatment to the roller 14. For example, the pattern may be provided as a binary mask image defining those areas to receive and not receive liquid treatment and the controller 28 may use the binary mask image to control the drop ejector 12 to apply the pattern to the roller 14.

The controller 28 may control the width over which the liquid treatment is applied by controlling the drop ejector 12 to provide liquid treatment while moving the drop ejector 12 parallel to the surface of the roller 14. Where the drop ejector 12 sprays the liquid treatment in a cone or triangular shape, the controller 28 may also control the width over which the liquid treatment is applied by controlling the drop ejector 12 to provide liquid treatment while moving the drop ejector 12 perpendicular to the surface of the roller 14. Where the drop ejector 12 includes an adjustable nozzle, the controller 28 may control the width over which the liquid treatment is applied by controlling the shape of the adjustable nozzle to provide a narrower or wider spray of liquid treatment.

Where the drop ejector 12 includes individually controllable segments, the controller 28 may control the width over which the liquid treatment is applied by controlling at least some of the segments to provide a narrower or wider spray of liquid treatment. Where the drop ejector 12 includes a plurality of controllable shutters, the controller 28 may control the width over which the liquid treatment is applied by controlling the shutters to restrict the spray of liquid treatment from the drop ejector 12 and thereby provide a narrower or wider spray of liquid treatment.

The controller 28 may control the length over which the liquid treatment is applied by controlling the drop ejector 12 to provide liquid treatment for a predetermined time period. Since the controller 28 may control the first roller 14 to rotate at a predetermined velocity, application of liquid treatment for the predetermined time period corresponds to liquid treatment being along the determined length. Where the drop ejector 12 includes an array of individually controllable segments, the controller 28 may control the length over which the liquid treatment is applied by controlling at least some of the segments to provide a shorter or longer spray of liquid treatment. Where the drop ejector 12 includes an array of controllable shutters, the controller 28 may control the length over which the liquid treatment is applied by controlling the shutters to restrict the spray of liquid treatment from the drop ejector 12 and thereby provide a shorter or longer spray of liquid treatment.

The controller 28 may control the pattern over which the liquid treatment is applied by controlling the position of the drop ejector 12 and the timing for applying the liquid treatment as described in the preceding paragraphs. By controlling the application of liquid treatment 15 over a predetermined width for a predetermined time or length, the controller 28 is able to control the drop ejector 12 to provide liquid treatment over particular areas of the media 26 (for example, over a photograph printed on the media 26).

At block 42, the controller 28 controls the first roller 14 to transfer the liquid treatment 15 from the first roller 14 to the second roller 16.

In more detail, the controller 28 controls the first roller 14 to rotate in an anti-clockwise direction. As the first roller 14 rotates, excess liquid treatment 15 is removed from the first roller 14 by the doctor blade 23, and the liquid treatment 15 is subsequently transferred from the first roller 14 to the second roller 16. The controller 28 also controls the second roller 16 to rotate (in a clockwise direction) and rotates the liquid treatment into the nip between the second roller 16 and the impression drum 24 and transfers the liquid treatment 15 to the media 26. The rotation of the second roller 16 and the impression drum 24 moves the media 26 through the media treatment apparatus 20 and toward the printer 22 (where the liquid treatment is primer) or toward an output tray (where the liquid treatment is varnish, or where the media treatment apparatus 20 is a standalone device).

The media treatment apparatus 20 provides an advantage in that liquid treatment is applied selectively to the media 26. For example, the media treatment apparatus 20 may accurately provide liquid treatment to a sheet of media and within the margins of the media. If media having different dimensions is introduced to the media treatment apparatus 20, the media treatment apparatus 20 may automatically determine the new dimensions and apply liquid treatment to fit the new dimensions. Consequently, the media treatment apparatus 20 may not require rollers to be replaced in order to provide liquid treatment to different dimensions of media.

Figure 3:
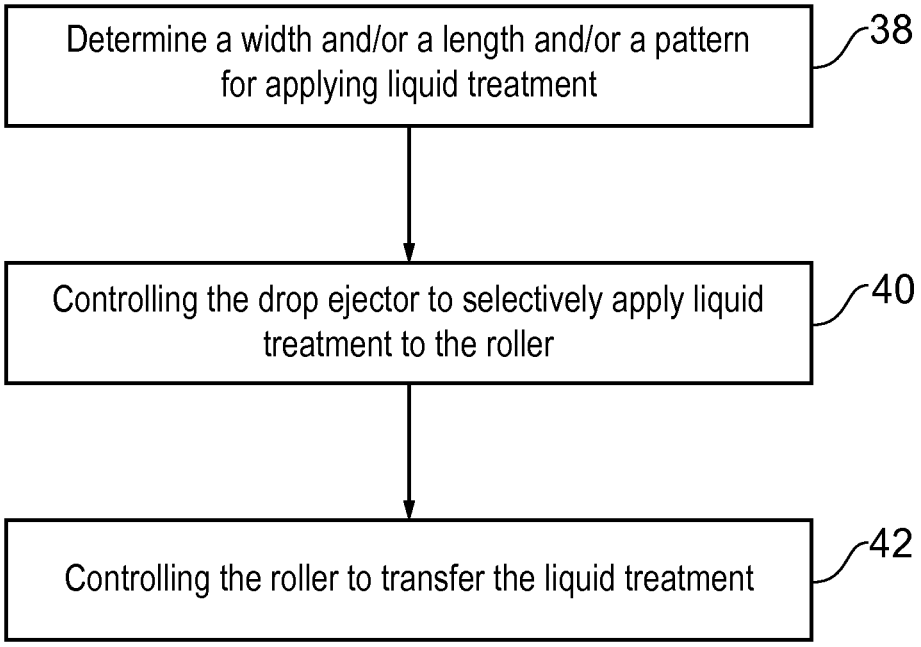
FIG. 3 illustrates a flow diagram of a method of controlling media treatment apparatus according to an example.

The blocks illustrated in the FIG. 3 may represent steps in a method and/or sections of code in the computer program 34. The illustration of a particular order to the blocks does not necessarily imply that there is a required or preferred order for the blocks and the order and arrangement of the blocks may be varied. Furthermore, it may be possible for some blocks to be omitted.

Although examples of the present invention have been described in the preceding paragraphs, it should be appreciated that modifications to the examples given can be made without departing from the scope of the invention as claimed. For example, the printer apparatus 18 may include a second media treatment apparatus in addition to the media treatment apparatus 20. The media treatment apparatus 18 is arranged to apply one of a pre-treatment liquid and a post-treatment liquid to media, and the second media treatment apparatus is arranged to apply the other of the pre-treatment liquid and the post-treatment liquid to the media.

In FIG. 2, the media treatment apparatus 20 is illustrated as being part of the printer apparatus 18. However, in some examples, the media treatment apparatus 20 may not be part of a printer apparatus and may be a standalone device.

Figure 4:
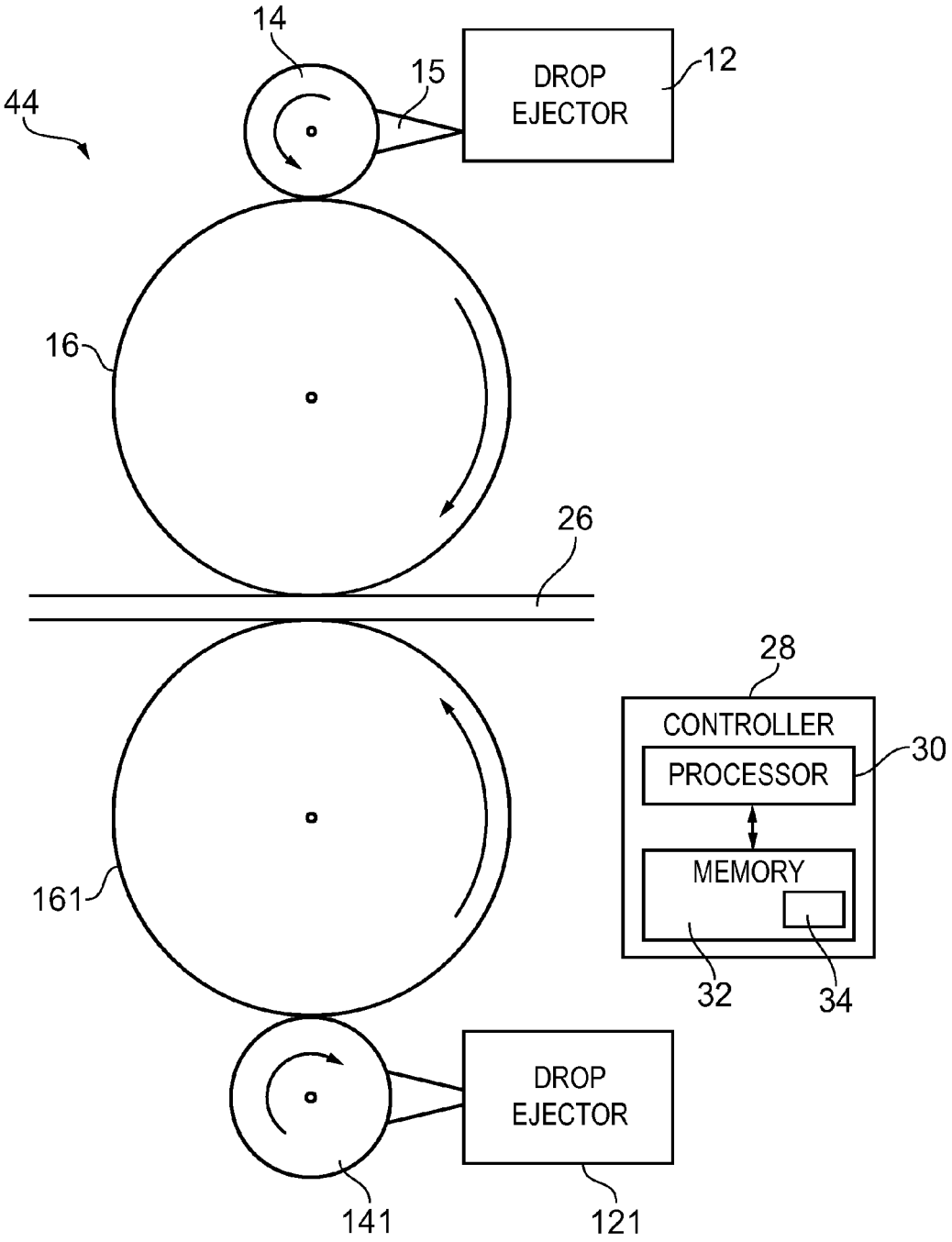
FIG. 4 illustrates a schematic diagram of another media treatment apparatus according to an example.

FIG. 4 illustrates a schematic diagram of another media treatment apparatus 44 according to an example. The media treatment apparatus 44 is similar to the media treatment apparatus 10 and 20 and where the features are similar, the same reference numerals are used. The media treatment apparatus 44 differs from the media treatment apparatus 20 in that it does not include an impression drum 24, but instead includes a second drop ejector 121, a third roller 141 and a fourth roller 161. The media treatment apparatus 44 is a duplex apparatus since media 26 is fed between the second roller 16 and the fourth roller 161 and the second roller 16 is arranged to provide liquid treatment to the top surface of the media 26, and the fourth roller 161 is arranged to provide liquid treatment to the bottom surface of the media 26.

The controller 28 is arranged to control the operation of the second drop ejector 121, the third roller 141 and the fourth roller 161 as described above with reference to FIGS. 2 and 3. That is, the controller 28 is arranged to control the second drop ejector 121, the third roller 141 and the fourth roller 161 so that a desired width and/or length and/or pattern of liquid treatment is transferred to the bottom surface of the media 26.

Figure 5:
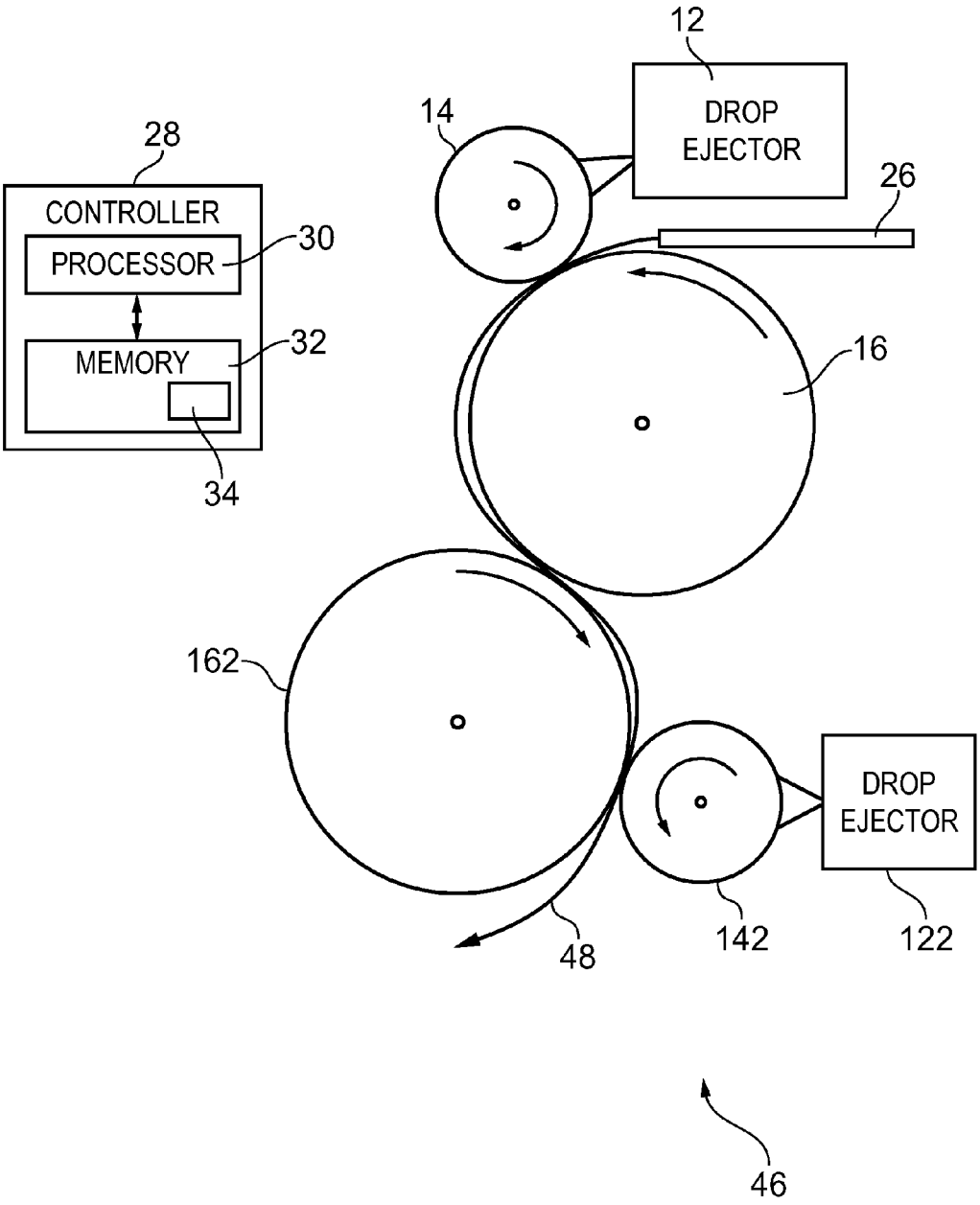
FIG. 5 illustrates a schematic diagram of a further media treatment apparatus according to an example.

FIG. 5 illustrates a schematic diagram of a further media treatment apparatus 46 according to an example. The media treatment apparatus 46 is similar to the media treatment apparatus 10 and 20 and where the features are similar, the same reference numerals are used. The media treatment apparatus 46 differs from the media treatment apparatus 20 in that it does not include an impression drum 24, but instead includes a second drop ejector 122, a third roller 142 and a fourth roller 162. The media treatment apparatus 44 is an in-line duplex apparatus since media 26 is fed between the first roller 14 and the second roller 16 and follows the path indicated by reference numeral 48 (that is, the media 26 is fed between the first roller 14 and the second roller 16 and then moves between the third roller 142 and the fourth roller 162). The first roller 14 is arranged to provide liquid treatment to the top surface of the media 26, and the third roller 142 is arranged to provide liquid treatment to the bottom surface of the media 26.

The controller 28 is arranged to control the operation of the second drop ejector 122, the third roller 142 and the fourth roller 162 as described above with reference to FIGS. 2 and 3. That is, the controller 28 is arranged to control the second drop ejector 122, the third roller 142 and the fourth roller 162 so that a desired width and/or length and/or pattern of liquid treatment is transferred to the bottom surface of the media 26.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. Media treatment apparatus to apply liquid treatment to media, the media treatment apparatus comprising:

a roller to receive liquid treatment and to transfer the liquid treatment;

a drop ejector to apply liquid treatment to the roller to transfer liquid treatment to the media;

a controller to control the drop ejector to selectively apply liquid treatment to the roller;

wherein the controller is arranged to determine a pattern for applying liquid treatment based on information for printing to the media, and to control the drop ejector to apply liquid treatment to the roller according to the determined pattern, and a second roller to receive the liquid treatment from a second drop ejector so as to apply the liquid treatment to the media, the roller and ejector being disposed to apply the liquid treatment to an opposite side of the media from the second roller and second drop ejector.

2. Media treatment apparatus as claimed in claim 1, wherein the roller comprises an anilox roller.

3. Media treatment apparatus as claimed in claim 1, wherein the liquid treatment is a primer or a varnish.

4. Media treatment apparatus as claimed in claim 1, further comprising another roller to receive liquid treatment from the roller and to apply the liquid treatment to the media.

5. Media treatment apparatus as claimed in claim 1, wherein the controller is arranged to determine the pattern for applying liquid treatment by analysing the content of the information for printing to the media, wherein liquid treatment is applied to areas that include content and not applied to areas that do not include content.

6. Media treatment apparatus as claimed in claim 1, wherein:

the drop ejector is a sprayer that sprays the liquid treatment in a cone or triangular shape; and the controller is arranged to determine a width for applying liquid treatment, the determined width being less than the width of the roller and media, and to control the drop ejector to apply liquid treatment to the roller along the determined width.

7. Media treatment apparatus as claimed in claim 1, wherein:

the drop ejector is a sprayer that sprays the liquid treatment in a cone or triangular shape; and the controller is arranged to determine a length for applying liquid treatment, and to control the drop ejector to apply liquid treatment to the roller for the determined length.

8. Media treatment apparatus as claimed in claim 1, wherein the drop ejector comprises a sprayer and a plurality of individually controlled shutters to selectively restrict a spray of the liquid treatment.

9. Media treatment apparatus as claimed in claim 1, further comprising a doctor blade adjacent the roller to remove excess liquid treatment from the roller.

10. Media treatment apparatus as claimed in claim 9, the controller to selectively control a distance between the doctor blade and the roller based on an amount of excess liquid treatment that should be removed.

11. Media treatment apparatus as claimed in claim 1, the controller to selectively adjust a velocity of the roller based on an amount of liquid treatment that should be applied.

12. Media treatment apparatus as claimed in claim 1, the controller to, based on an amount of liquid treatment that should be applied, selectively adjust any of: (1) a distance between the drop ejector and the roller, (2) a flow rate of the drop ejector, and (3) a pressure of fluid from the drop ejector.

13. Media treatment apparatus as claimed in claim 1, further comprising a sensor for sending dimensions of the media, the controller to determine the pattern for applying liquid treatment based on output from the sensor.

14. Media treatment apparatus as claimed in claim 1, the controller to determine the pattern for applying liquid treatment based on a user input signal indicating dimensions of the media.

15. A method of controlling media treatment apparatus, the method comprising:

determining a pattern for applying liquid treatment based on information for printing to an object;

controlling a drop ejector and a second drop ejector to selectively apply liquid treatment to a roller and a second roller according to the determined pattern; and controlling the roller and the second roller to transfer the liquid treatment to the object and to an opposite side of the object, respectively.

16. A method as claimed in claim 15, further comprising analysing the content of the information for printing to the object to determine the pattern for applying liquid treatment, wherein liquid treatment is applied to areas that include content and not applied to areas that do not include content.

17. A method as claimed in claim 15, further comprising:

determining a width for applying liquid treatment, the determined width being less than the width of the roller; and controlling the drop ejector to apply liquid treatment to the roller along the determined width.

18. A method as claimed in claim 15, further comprising:

determining a length for applying liquid treatment; and controlling the drop ejector to apply liquid treatment to the roller for the determined length.

19. A non-transitory computer-readable storage medium encoded with instructions that, when performed by a processor, cause performance of a method according to claim 15.

* * * * *